United States Patent [19]

Hassler et al.

[11] 4,014,659

[45] Mar. 29, 1977

[54] IMPREGNATED COMPOUND METAL AS CONTACT MATERIAL FOR VACUUM SWITCHES AND METHOD FOR ITS MANUFACTURE

[75] Inventors: Heinrich Hassler, Wendelstein; Horst Kippenberg, Nurnberg-Weiherhaus, both of Germany

[73] Assignee: Siemens Aktiengesellschaft, Munich, Germany

[22] Filed: Oct. 31, 1974

[21] Appl. No.: 519,678

[30] Foreign Application Priority Data

Nov. 16, 1973 Germany ..... 2357333

[52] U.S. Cl. ..... 29/182.1; 75/200

[51] Int. Cl.[2] ..... B22F 3/00; B22F 1/04; C22C 33/02

[58] Field of Search ..... 29/182.1; 75/200; 200/279, 265

[56] References Cited

UNITED STATES PATENTS

| | | | |
|---|---|---|---|
| 3,125,441 | 3/1964 | Lafferty | 29/182.1 |
| 3,337,338 | 8/1967 | Krock et al. | 75/200 |
| 3,360,348 | 12/1967 | Schreiner | 29/182.1 |
| 3,440,043 | 4/1969 | Zdnuk et al. | 29/182.1 |
| 3,721,550 | 3/1973 | Schreiner et al. | 29/182.1 |
| 3,819,897 | 6/1974 | Pecke et al. | 200/263 |

*Primary Examiner*—Benjamin R. Padgett
*Assistant Examiner*—Josephine Lloyd
*Attorney, Agent, or Firm*—Kenyon & Kenyon Reilly Carr & Chapin

[57] ABSTRACT

An impregnated compound metal is provided comprising a metal matrix comprising a metallic main constituent having a melting point above 1400° C and a metallic embrittlement additive impregnated with an impregnating metal or metal alloy, brittle intermetallic phases or mixed crystals forming between the main constituent and the embrittlement additive at sintering temperatures above 1200° C. The percentage of embrittlement additive relative to the main constituent is 0.5 to 10 percent by weight. The melting points of all constituents are above 2000° C.

5 Claims, No Drawings

IMPREGNATED COMPOUND METAL AS CONTACT MATERIAL FOR VACUUM SWITCHES AND METHOD FOR ITS MANUFACTURE

BACKGROUND OF THE INVENTION

The invention relates to an impregnated compound metal as a contact material for vacuum switches, comprising a sintered metal matrix impregnated by an impregnating metal or impregnating metal alloy, the melting point of said matrix being higher than that of the impregnating substance.

Contact materials for vacuum switches whose field of application should also cover the area of higher capacities, must meet as basic conditions the requirements of high current breaking ability (> 10kA) and good dielectric strength (> 12kV). At the same time, such materials must have a long service life, i.e., they must burn off little and their welding forces must be adequately low (< 800 N). Pure alloys based on copper or sintered impregnated materials have been used as contact materials. These sintered impregnated materials consist of a sintered porous metal matrix of high melting point which is impregnated by a metal or metal alloy of lower melting point and better electric conductivity, forming a so-called impregnated compound metal. While the contact materials mentioned do meet the requirements of an adequately long service life and high breaking current, they do not satisfy the requirements of a sufficiently low welding force. It has heretofore been attempted to admix bismuth or tellurium to the said alloys on the basis of copper or to the sintered impregnated materials as ingredients lowering the welding force. But due to their low melting points (< 2000° C), bismuth and tellurium develop very high vapor pressures, thereby reducing the quenching ability of the switch and, hence, its current breaking capability in an impermissible manner.

SUMMARY OF THE INVENTION

It is an object of the invention to create a contact material for vacuum switches which, in addition to good dielectric strength, has the lowest possible welding forces and a high current breaking capability.

According to the invention, this problem is solved by an impregnated compound metal having a metal matrix comprising a metallic main constituent having a melting point above 1400° C and a metallic embrittlement additive; wherein the main constituent and the embrittlement additive form brittle imtermetallic phases or mixed crystals at sintering temperatures above 1200° C; wherein the embrittlement additive comprises from 0.5 to 10 weight percent of the main constituent; and the melting point of the impregnated substance lies between 850° C and the respective sintering temperature; and wherein the boiling points of the main constituent, embrittlement additive and impregnated substance are above 2000° C; based on a pressure of 760 Torr.

The main constituents are preferably the metals tungsten, molybdenum, chromium, nickel and iron.

Aluminum and tin are used to particular advantage as embrittlement additives.

Copper, silver or alloys of these metals are advantageously used as impregnating substances.

According to the method of this invention, the impregnated compound metal is produced by cold pressing a mixture in powdered form of the main constituent and embrittlement additive into a blank; then sintering the mixture at a temperature above 1200° C to form a sintered metal matrix and finally impregnating the matrix with the impregnating substance at a temperature below the sintering temperature of the matrix.

In an advantageous modification, the impregnated compound metal according to the invention is produced by first mixing the main constituent and the embrittlement additive in powder form, filling the mixture into a mold and sintering it unpressed at a temperature above 1200° C to form a sintered metal matrix, and then impregnating the sintered metal matrix with an impregnating substance at a temperature below the sintering temperature.

The contact material according to the invention is characterized in particular by its low welding forces and its high current breaking capability. The lowering of the welding forces is achieved by brittle, intermetallic phases or mixed crystals which form due to diffusion between the main constituent and the embrittlement additive at sintering temperatures above 1200° C, while the current breaking capability is assured by the fact that the boiling points of all constituents are above 2000° C. Embrittlement additives such as aluminum and tin bring about the desired embrittlement of the metal matrix when admixed in small quantities. In order to obtain the minimum pore volume of at least 20 percent by volume of the metal matrix, which is required for adequate impregnation, the melting point of the main constituent must be at least 200° C higher than the sintering temperature, i.e. above 1400° C. The melting point of the impregnating substance should be above a temperature of approximately 850° C, required for brazing the contact material, but it must not be higher than the respective sintering temperature.

The invention will be explained in greater detail by way of the following examples.

EXAMPLE 1

A mixture composed of 99 weight-percent chromium powder of a grain size smaller than 100 μm and 1 weight-percent aluminum powder is filled into a graphite mold and sintered unpressed under vacuum at 1200° C for one hour. During the sintering process there developed between the chromium and the aluminum, brittle, intermetallic phases or mixed crystals. The sintered part is subsequently impregnated with copper for 30 minutes at 1150° C. The impregnating atmosphere consists of hydrogen which is pumped off again after the impregnation has been concluded, but before the copper solidifies.

EXAMPLE 2

A mixture composed of 40 weight-percent nickel powder of a grain size of 150 μm or less and 4 weight-percent aluminum powder of a grain size of 50 μm is cold pressed into a blank under a pressure of 10,000 N/cm². The blank is subsequently sintered under vacuum for one hour at 1200° C. After sintering, the porous blank is impregnated with silver at 1050° C in a hydrogen atmosphere. When the impregnation was concluded, but before the silver solidified, the hydrogen was pumped off.

EXAMPLE 3

A mixture composed of 99 weight-percent molybdenum powder of a grain size below 100 μm and 1 weight-percent aluminum powder of a grain size below 50 μm is cold pressed into a blank under a pressure of 25,000 N/cm². The blank is subsequently sintered under vacuum in a graphiteless atmosphere at 1600° C for 1 hour. After sintering, the porous blank is impregnated with silver in covered graphite molds at 1200° C for 30 minutes in a hydrogen atmosphere. This was followed by a 30 minute degassing operation.

EXAMPLE 4

A mixture composed of 95 weight-percent cobalt powder of a grain size below 150 μm and 5 weight-percent tin powder of a grain size below 50 μm is cold pressed into a blank under a pressure of 20,000 N/cm². The blank is subsequently sintered under vacuum in a covered graphite mold at 1260° C for 1 hour. After sintering, the porous blank is impregnated with copper in graphite molds at 1200° C for 30 minutes in a hydrogen atmosphere. Following the impregnation a 1 hour vacuum degassing operation took place at 1200° C.

EXAMPLE 5

A mixture composed of 99 weight-percent cobalt powder of a grain size below 150 μm and 1 weight-percent aluminum powder of a grain size below 50 μm is cold pressed into a blank under a pressure of 15,000 N/cm². The blank is subsequently sintered under vacuum at 1300° C for 1 hour in a covered ceramic mold. After sintering, the porous blank is impregnated with silver at 1200° C in a hydrogen atmosphere in a graphite mold. A 1 hour vacuum degassing operation took place after the impregnation.

What is claimed is:

1. Impregnated compound metal as a contact material for vacuum switches, comprising a sintered metal matrix impregnated with an impregnating metal or impregnating metal alloy, the melting point of said metal matrix being higher than that of the impregnating metal or alloy, wherein the metal matrix comprises a metallic main constituent having a melting point above 1400° C and a metallic embrittlement additive; wherein brittle, intermetallic phases or mixed crystals are formed between said metallic main constituent and said embrittlement additive at temperatures above about 1200° C; wherein the embrittlement additive comprises between 0.5 and 10 weight-percent relative to the main constituent; wherein the melting point of the impregnating metal or alloy is between 850° C and the sintering temperature of said matrix; and wherein the boiling points of the main constituent, embrittlement metal or alloy and impregnating substance are above 2000° C, based on a pressure of 760 Torr.

2. The impregnated compound metal according to claim 1, wherein the main constituent is selected from the group consisting of tungsten, molybdenum, chromium, nickel and iron and the embrittlement additive is aluminum or tin.

3. The impregnated compound metal according to claim 1, the impregnating substance is selected from the group consisting of copper, silver and alloys thereof.

4. A method for the manufacture of the impregnated compound metal of claim 1, comprising;

a. cold pressing a powdered mixture of a main metallic constituent and metallic embrittlement additive;
b. sintering said mixture at a temperature above 1200° C to form a sintered metal matrix; and
c. impregnating said matrix with an impregnating substance at a temperature below the sintering temperature of the matrix.

5. A method for the manufacture of the impregnated compound metal according to claim 1 comprising:

a. forming a powdered mixture of main metallic constituent and metallic embrittlement additive;
b. sintering said mixture in a mold without pressing at a temperature of 1200° C to form a sintered metal matrix; and
c. impregnating said matrix with an impregnating metal or alloy at a temperature below the sintering temperature of the matrix.

* * * * *